US010767450B2

(12) United States Patent
Yi et al.

(10) Patent No.: US 10,767,450 B2
(45) Date of Patent: Sep. 8, 2020

(54) SAND CONTROL SCREEN FOR HEAVY OIL THERMAL RECOVERY

(71) Applicant: STARSE ENERGY AND TECHNOLOGY (GROUP) CO., LTD, Beijing (CN)

(72) Inventors: Huian Yi, Beijing (CN); Boren Li, Beijing (CN); Zhenxiang Wang, Beijing (CN); Qiansheng Zhuang, Beijing (CN); Shanyin Chen, Beijing (CN); Miaoren Liu, Beijing (CN); Xipeng Huang, Beijing (CN); Wenfei Li, Beijing (CN); Qizun Yi, Beijing (CN); Zheng Tao, Beijing (CN)

(73) Assignee: STARSE ENERGY AND TECHNOLOGY (GROUP) CO., LTD, Beijing (CN)

( * ) Notice: Subject to any disclaimer, the term of this patent is extended or adjusted under 35 U.S.C. 154(b) by 0 days.

(21) Appl. No.: 16/325,155

(22) PCT Filed: Sep. 13, 2016

(86) PCT No.: PCT/CN2016/098848

§ 371 (c)(1),
(2) Date: Feb. 12, 2019

(87) PCT Pub. No.: WO2018/049560

PCT Pub. Date: Mar. 22, 2018

(65) Prior Publication Data

US 2019/0195052 A1 Jun. 27, 2019

(51) Int. Cl.
*E21B 43/08* (2006.01)
*E21B 43/24* (2006.01)
(Continued)

(52) U.S. Cl.
CPC ..... *E21B 43/08* (2013.01); *E21B 43/04* (2013.01); *E21B 43/086* (2013.01); *E21B 43/10* (2013.01); *E21B 43/24* (2013.01)

(58) Field of Classification Search
CPC ..... E21B 43/08; E21B 43/24; E21B 43/086; E21B 43/04; E21B 43/10
See application file for complete search history.

(56) References Cited

U.S. PATENT DOCUMENTS 5,611,399 A 3/1997 Richard et al.
5,842,522 A * 12/1998 Echols ..... B01D 29/111 166/378

FOREIGN PATENT DOCUMENTS

CN 2536786 Y 2/2003
CN 200999607 Y 1/2008
(Continued)

*Primary Examiner* — Wei Wang
(74) *Attorney, Agent, or Firm* — Muncy, Geissler, Olds & Lowe, P.C.

(57) ABSTRACT

A sand control screen for heavy oil thermal recovery, including: a core base pipe having a plurality of base-pipe holes distributed on a pipe body thereof; a filtering sleeve sleeved on the core base pipe and arranged with respect to the base pipe holes; and a non-welded support disk mounted on the core base pipe and fastening the filter sleeve to the core base pipe by means of a wedge insertion locking and sealing structure. The invention solves the problems in the prior art in which sand control screen has a poor reliability in a high-temperature condition of a thermal production well, resulting in potential safety risks of down hole sand control operation of the screens. In addition, the sand control screen of the present invention has a long service life, thus improving cost effectiveness of oil wells.

7 Claims, 3 Drawing Sheets

(51) Int. Cl.
*E21B 43/04* (2006.01)
*E21B 43/10* (2006.01)

(56) References Cited

FOREIGN PATENT DOCUMENTS

| | | | |
|---|---|---|---|
| CN | 101270644 | A | 9/2008 |
| CN | 102108848 | A | 6/2011 |
| CN | 104822897 | A | 8/2015 |

* cited by examiner

SAND CONTROL SCREEN FOR HEAVY OIL THERMAL RECOVERY

FIELD OF INVENTION

The present invention relates to an oil-field development equipment, and in particular to a sand control screen for heavy oil thermal recovery.

RELATED ART

At present, development of most heavy oil fields needs to be exploited with a multi-cycle steam-huff-and-puff method at a high temperature of 350° C. As the temperature increases, the number of changed cycles increases, which brings more serious problems in sand control. Further, the domestic ocean oil fields are gradually changed from continental shelf area to deep water area, resulting in increased depth of the oil wells, more complicated well conditions, and worse formation conditions. There are many high temperature wells and high pressure wells. The corrosive of formation fluid is also increased.

A conventional method for fastening and protecting a filtering sleeve in a compound sand control screen is to mount a ring-shaped support disk at both ends of the sleeve, and to connect the ring-shaped support disk to a base pipe via a welding process. Such a welded-type support disk is suitable for well conditions with good formation conditions, such as oil wells having formation fluid of a low pH value, a low formation pressure and a moderate temperature (no more than 200° C.), but could not be applied to some oil wells such as high temperature wells, high pressure wells, oil wells having formation fluid of a high pH value, and oil wells exploited with a steam-huff-and-puff method, since the welded structure may be easily damaged, which may lead to failure in the sand control. This is because, on one hand, impurity elements in weld metal are easy to react chemically with mineral ions in a strong-acid/strong-alkaline liquid environment under high temperature and high pressure, which may cause (electro) chemical corrosion on the weld metal. On the other hand, due to the welding process, a metallurgical phase transformation reaction occurs locally in the support disk and the base pipe connected with the welded metal. As a result, unevenness in grain size, instability in the mechanical properties, and hot cracks under high temperature and high pressure may occur in such a reaction region. Typically, a heat treatment after the welding process may improve performance of the welded structure. However, in specific processing and assembling processes of the compound sand control screen, it is impossible to perform such a heat treatment after the welding process of the support disk. Accordingly, those defects in the welded structure could not be prevented.

Further, during thermal recovery of oil wells by injecting steam in a huff-and-puff manner, the design for the filtering structure in a common screen is inadequate to deal with the multi-cycle steam-huff-and-puff at a high temperature of 350° C. in heavy oil recovery. During the steam injection, steam leaked through the base pipe holes of the common screen may erode the screen directly. Further, during the recovery, the screen may be eroded and damaged by a sand-carrying fluid, and the welded structure may also be damaged, which may lead to failure in sand control and cause the whole shaft to be buried by the sand and then shut down.

SUMMARY OF INVENTION

One technical problem to be solved by the present invention is to provide a sand control screen for steam injection and thermal recovery for heavy oil at a high temperature and implementing both functions of injection and recovery, so as to solve the problems in which the sand control screen has a poor reliability in a high-temperature condition of a thermal production well, resulting in potential safety risks of down hole sand control operation of the screens.

To achieve the above object, the present invention provides sand control screen for heavy oil thermal recovery, comprising: a core base pipe having a plurality of base-pipe holes distributed on a pipe body thereof; a filtering sleeve sleeved on the core base pipe and arranged with respect to the base pipe holes; and a non-welded support disk mounted on the core base pipe and fastening the filter sleeve to the core base pipe by means of a wedge insertion locking and sealing structure.

In the above sand control screen, the filter sleeve includes: an inner sheath having a bridge-like steam injection sand control structure and sleeved on the core base pipe, a plurality of bow-shaped structures being arranged on a sheath body of the inner sheath evenly, a bridge-like gap being formed between the bow-shaped structures and the sheath body, and an inner wall of the bow-shaped structures being tightly attached to an outer circumferential surface of the core base pipe 1; and an outer sheath sleeved on the inner sheath, a plurality of outer filtering holes distributed on a sheath body of the outer sheath evenly.

In the above sand control screen, the bow-shaped structures are formed by stamping on the sheath body of the inner sheath.

In the above sand control screen, a plurality of blind sections are distributed on the sheath body of the inner sheath evenly, and are arranged corresponding to the base-pipe holes.

In the above sand control screen, the bow-shaped structures are alternately distributed along a circumferential direction of the sheath body of the inner sheath.

In the above sand control screen, both end of the filter sleeve are fastened by the non-welded support disk.

In the above sand control screen, the non-welded support disk includes: a support disk body including a disk body, and a through hole arranged coaxially with the disk body, the through hole including a circular hole and an internal tapered hole which are connected in this order, the diameter of the circular hole matching the outer diameter of the core base pipe; a tapered locking sleeve including a sleeve body, and a sleeve hole arranged coaxially with the sleeve body, the diameter of the sleeve hole matching the outer diameter of the core base pipe, the outer surface of the sleeve body being a cone-cylinder surface matching the internal tapered hole, and the cone-cylinder surface being inserted into the internal tapered hole; and a connecting member for connecting and fastening the support disk body and the tapered locking sleeve.

In the above sand control screen, the connecting member includes cylindrical pins, cylindrical pin holes are provided in the support disk body, the tapered locking sleeve and the core base pipe respectively and correspondingly, and the cylindrical pins are inserted into the cylindrical pin holes, respectively.

In the above sand control screen, the cylindrical pin holes are welded to outer ends of the cylindrical pins respectively, and polished.

In the above sand control screen, a corrugated structure is further provided on the sleeve body, and is close to an end of the cone-cylinder surface that has a smaller diameter.

The invention will now be described in detail with reference to the accompanying drawings and specific embodiments, but is not to limited thereto.

REFERENCE NUMERALS

1 core base pipe
- 11 base-pipe hole

2 filtering sleeve
- 21 inner sheath
- 22 outer sheath
- 23 bow-shaped structures
- 24 blind section
- 25 bridge-like gap

3 non-welded support disk
- 31 support disk body
- 32 tapered locking sleeve
- 33 connecting member
- 34 circular hole
- 35 internal tapered hole
- 36 cylindrical pin holes
- 37 corrugated structure
- 38, 39 cylindrical pin

DETAILED DESCRIPTION OF INVENTION

The structural principles and operation principles of the present invention will be described in detail below in conjunction with the accompanying drawings.

Figure 1:
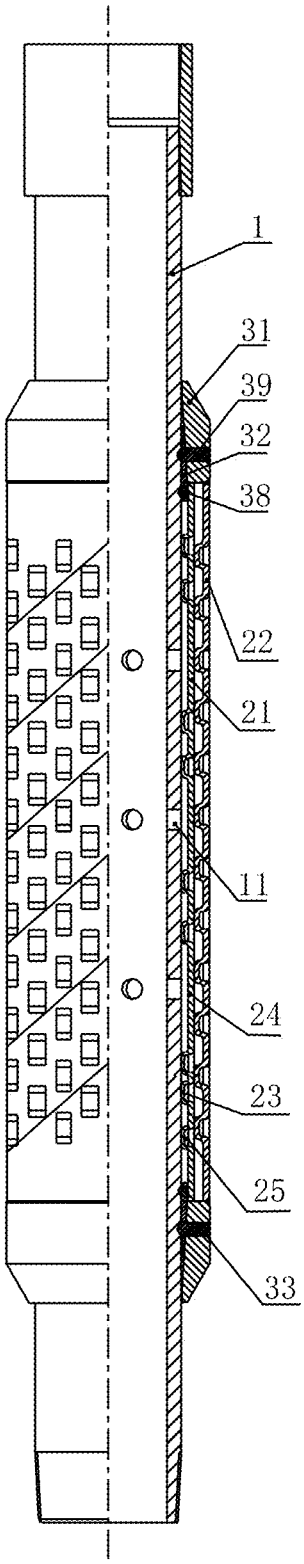
FIG. 1 is a schematic diagram showing a structure of a sand control screen according to an embodiment of the present invention.

Referring to FIG. 1, FIG. 1 is a schematic diagram showing a structure of a sand control screen according to an embodiment of the present invention. The sand control screen for heavy oil thermal recovery in the present invention comprises: a core base pipe 1 having a plurality of base-pipe holes 11 distributed on a pipe body thereof; a filtering sleeve 2 sleeved on the core base pipe 1 and arranged with respect to the base pipe holes 11; and a non-welded support disk 3 mounted on the core base pipe 1 and fastening the filtering sleeve 2 to the core base pipe 1 by means of a wedge insertion locking and sealing structure.

Here, both ends of the filter sleeve 2 are fastened by the non-welded support disk 3.

Figure 2:
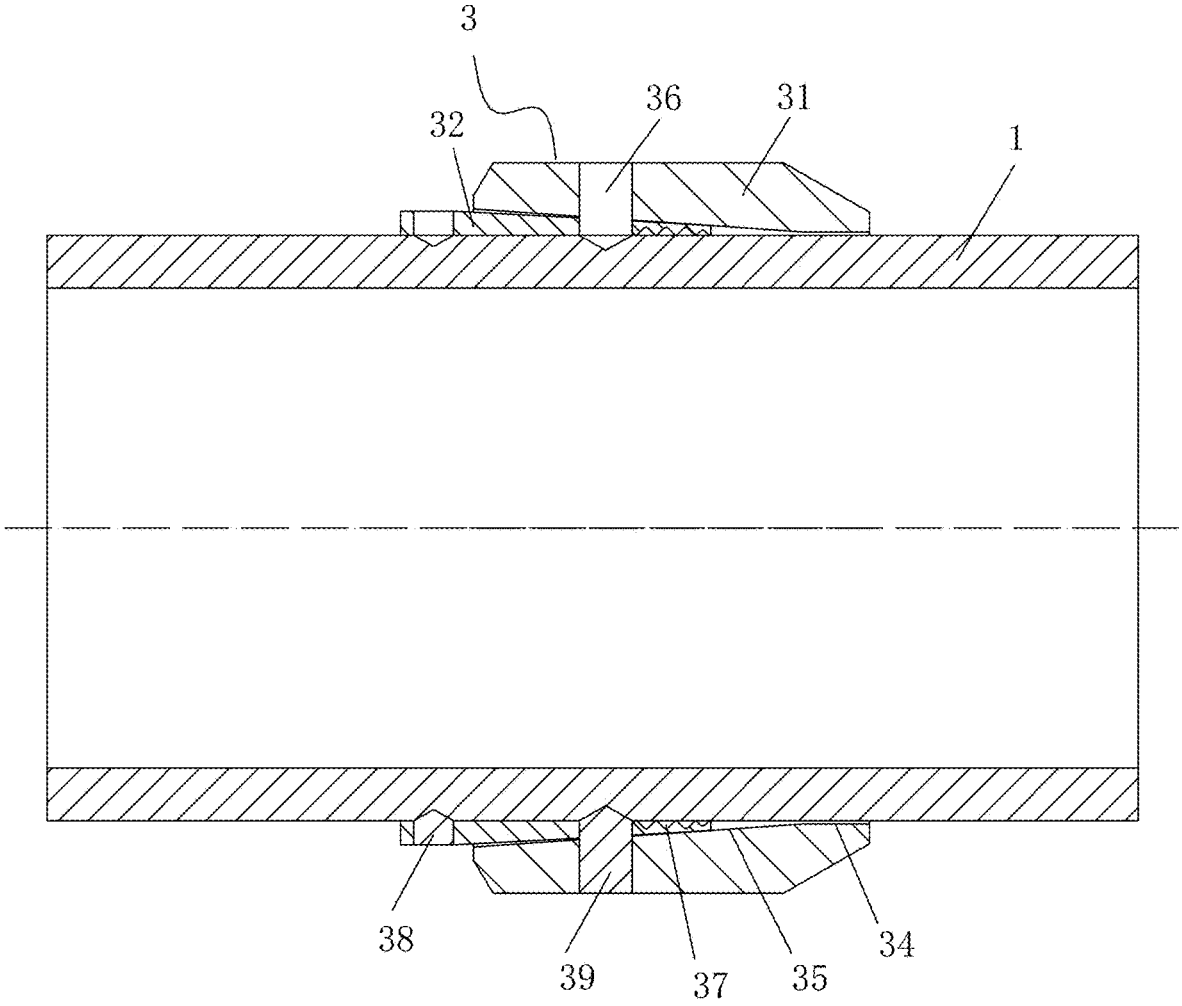
FIG. 2 is a schematic diagram showing a structure of the non-welded support disk according to an embodiment of the present invention.

Referring to FIG. 2, FIG. 2 is a schematic diagram showing a structure of the non-welded support disk according to an embodiment of the present invention. In this embodiment, the non-welded support disk 3 includes a support disk body 31, a tapered locking sleeve 32, and a connecting member 33 for connecting and fastening the support disk body 31 and the tapered locking sleeve 32.

The support disk body 31 includes a disk body, and a through hole arranged coaxially with the disk body. The through hole includes a circular hole 34 and an internal tapered hole 35, which are connected in this order. The diameter of the circular hole 34 matches the outer diameter of the core base pipe 1.

The tapered locking sleeve 32 includes a sleeve body, and a sleeve hole arranged coaxially with the sleeve body. The diameter of the sleeve hole matches the outer diameter of the core base pipe 1. The outer surface of the sleeve body is a cone-cylinder surface matching the internal tapered hole 35. The cone-cylinder surface is inserted into the internal tapered hole 35. Further, a corrugated structure 37 is provided on the sleeve body. The corrugated structure 37 is close to an end of the cone-cylinder surface that has a smaller diameter.

Preferably, the connecting member 33 includes cylindrical pins. Cylindrical pin holes 36 may be provided in the support disk body 31, the tapered locking sleeve 32 and the core base pipe 1 respectively and correspondingly. The cylindrical pins are inserted into the cylindrical pin holes, respectively. The tapered locking sleeve 32 may be locked tightly to the core base pipe 1 by means of a cylindrical pin 38. The support disk body 31 may be locked tightly to the tapered locking sleeve 32 and the core base pipe 1 by means of a cylindrical pin 39. Here, the cylindrical pin holes 36 are welded to outer ends of the cylindrical pins 38 and 39 respectively, and polished.

Figure 3:
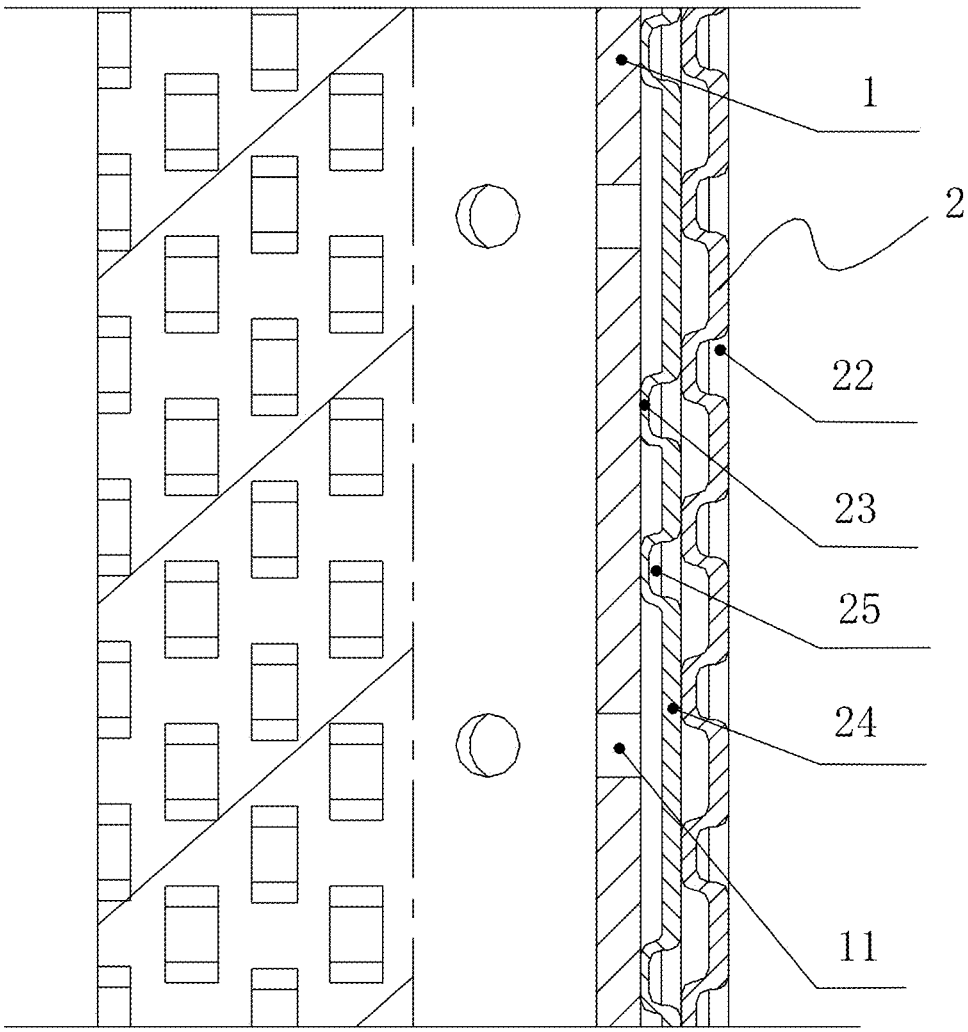
FIG. 3 is a schematic diagram showing a structure of the filtering sleeve according to an embodiment of the present invention. In this embodiment, the filtering sleeve 2 includes an inner sheath 21 and an outer sheath 22.

Referring to FIG. 3, FIG. 3 is a schematic diagram showing a structure of the filtering sleeve according to an embodiment of the present invention. In this embodiment, the filtering sleeve 2 includes an inner sheath 21 and an outer sheath 22.

The inner sheath 21 has a bridge-like steam injection sand control structure and is sleeved on the core base pipe 1. A plurality of blind sections 24 are distributed on a sheath body of the inner sheath 21 evenly. The blind sections 24 are arranged corresponding to the base-pipe holes 11. A plurality of bow-shaped structures 23 are arranged on the sheath body of the inner sheath 21. A bridge-like gap 25, which has a function of sand control, is formed between the bow-shaped structures 23 and the sheath body of the inner sheath 21. An inner wall of the bow-shaped structures 23 is tightly attached to an outer circumferential surface of the core base pipe 1, to ensure that the bow-shaped structures 23 have sufficient impact resistance.

The outer sheath 22 is preferably a bridge-like sand control filtering sheath having functions of sand control and protection, and is sleeved on the inner sheath 21. A plurality of bow-shaped structures 23 for forming bridge-like gaps are arranged on the sheath body of the outer sheath 22. The bridge-like gaps serve as outer filtering holes for preventing the sand and protecting the inner sheath. The through holes in the outer sheath 22 are similar to those in the inner sheath 21. The bow-shaped structures 23 are formed by stamping on the sheath body of the inner sheath 21 having a bridge-like steam injection sand control structure. With each bow-shaped structure 23, two sand filtering structures with an elongated bridge-like gap 25 are formed on the sheath body. Preferably, the bow-shaped structures 23 are alternately distributed along a circumferential direction of the sheath body of the inner sheath 21 having a bridge-like steam injection sand control structure, to form a filtering layer of a sand control screen for thermal recovery at a high temperature.

In the present invention, a connection in a wedge insertion locking and sealing structure is provided. Specifically, on one hand, the tapered locking sleeve 32 is wedged into the internal tapered hole 35 of the support disk body 31, providing a spring-like structure which may generate a tension (a restoring force) for fastening the support disk body 31 to the core base pipe 1 tightly. On the other hand, a surface at an end of the corrugated structure 37 of the tapered locking sleeve 32 that has a smaller diameter end is closely attached to an inner surface of the internal tapered hole 35 of the support disk body 31 and an outer surface of the core base pipe 1 under the action of a mechanical force. Due to a pressure difference during the oil well operation, the corrugated structure 37 is further pressed and becomes unstable, resulting in a large bending deformation in an axis direction. Accordingly, the inner and outer surfaces are pressed to be attached to each other more closely, thereby realizing sealing between metal surfaces.

Referring to FIG. 3, during the oil well production, as the sand carrying liquid (oil) passes through the bridge-like sand control filtering outer sheath 22, sand particles are filtered and blocked outside the sand control screen. A small amount of fine sand particles is allowed to pass through. Then, the sand carrying liquid is further filtered through the inner sheath 21 having a bridge-like steam injection sand control structure, and flows into the base pipe holes 11. With two filtering processes, sand particles gradually form sand bridges outside the outer sheath 22 and between the outer sheath 22 and the inner sheath 21, for further assisting in sand control.

During the steam injection of the oil well, injected steam enters the blind section 24 of the inner sheath 21 having a bridge-like steam injection sand control structure through the base pipe holes 11. With the guide of the blind section 24, the injected steam enters a filtering section and exits from positions such as the bridge-like gap 25, and is then diffused to the oil layer through the outer sheath 22. Such changes in the fluid may prohibit the direct erosion on the screen by the steam at a high temperature, and may implement a function of plugging removal in the sand control screen, which may prolong the life of the sand control screen and improve the economic benefits of the oil well.

Of course, various other embodiments of the invention are possible, and various corresponding changes and modifications may be effected therein by those skilled in the art without departing from the spirit and spirit of the invention, which should fall within the scope of the appended claims.

INDUSTRIAL APPLICABILITY

In the present invention, the sand control screen is formed through a wedge insertion locking and sealing structure, instead of the welding process. Such a mechanical structure is characterizing in two aspects. One is that the tapered locking sleeve is wedged into the internal tapered hole of the support disk body, providing a spring-like structure which may generate a tension for fastening the support disk body to the core base pipe tightly. The other is that a surface at an end of the corrugated structure of the tapered locking sleeve that has a smaller diameter end is closely attached to an inner surface of the internal tapered hole of the support disk body and an outer surface of the base pipe under the action of a mechanical force. Due to a pressure difference during the oil well operation, the corrugated structure is further pressed and becomes unstable, resulting in a large bending deformation in an axis direction. Accordingly, the inner and outer surfaces are pressed to be attached to each other more closely, thereby realizing sealing between metal surfaces.

In addition, the outer sheath of the filtering sleeve in the sand control screen according to the present invention adopts a bridge-like structure which provides lateral holes to changes the flowing direction of the fluid. Thus, it is not easily eroded and worn, is not easily blocked, and has a high structural strength and good sand control effects. The structure of the inner sheath having a bridge-like steam injection sand control structure is the same as that of the outer sheath, which may achieve beneficial effects in sand control. Additionally, blind sections are distributed evenly in the inner sheath, which is facilitate to protect the screen pipe from being eroded and damaged directly in a case of steam injection, to implement sand control effectively and prolong the service life of the screen in a case of multi-cycle steam-huff-and-puff thermal recovery for heavy oil at a high temperature.

What is claimed is:

1. A sand control screen for heavy oil thermal recovery, comprising:

a core base pipe having a plurality of base-pipe holes distributed on a pipe body thereof; a filtering sleeve sleeved on the core base pipe and arranged with respect to the base pipe holes; and a non-welded support disk mounted on the core base pipe and fastening the filter sleeve to the core base pipe by means of a wedge insertion locking and sealing structure, said non-welded support disk comprising:

a support disk body including a disk body, and a through hole arranged coaxially with the disk body, the through hole including a circular hole and an internal tapered hole which are connected in this order, the diameter of the circular hole matching the outer diameter of the core base pipe;

a tapered locking sleeve including a sleeve body, and a sleeve hole arranged coaxially with the sleeve body, the diameter of the sleeve hole matching the outer diameter of the core base pipe, the outer surface of the sleeve body being a cone-cylinder surface matching the internal tapered hole, and the cone-cylinder surface being inserted into the internal tapered hole; and a connecting member for connecting and fastening the support disk body and the tapered locking sleeve, wherein said connecting member includes cylindrical pins, and cylindrical pin holes are provided in the support disk body, the tapered locking sleeve, and the core base pipe respectively and correspondingly, the cylindrical pins are configured to be inserted into the cylindrical pin holes, respectively, wherein the cylindrical pin holes are welded to outer ends of the cylindrical pins respectively, and polished.

2. The sand control screen according to claim 1, wherein the filter sleeve includes:

an inner sheath having a bridge-like steam injection sand control structure and sleeved on the core base pipe, a plurality of bow-shaped structures being arranged on a sheath body of the inner sheath evenly, a bridge-like gap being formed between the bow-shaped structures and the sheath body, and an inner wall of the bow-shaped structures being tightly attached to an outer circumferential surface of the core base pipe; and an outer sheath sleeved on the inner sheath, a plurality of outer filtering holes distributed on a sheath body of the outer sheath evenly.

3. The sand control screen according to claim 2, wherein the bow-shaped structures are formed by stamping on the sheath body of the inner sheath.

4. The sand control screen according to claim 2, wherein a plurality of blind sections are distributed on the sheath body of the inner sheath evenly, and are arranged corresponding to the base-pipe holes.

5. The sand control screen according to claim 2, wherein the bow-shaped structures are alternately distributed along a circumferential direction of the sheath body of the inner sheath.

6. The sand control screen according to claim 2, wherein both ends of the filter sleeve are fastened by the non-welded support disk.

7. The sand control screen according to claim 1, wherein a corrugated structure is further provided on the sleeve body, and is close to an end of the cone-cylinder surface that has a smaller diameter.

* * * * *